United States Patent [19]

Ohbayashi et al.

[11] Patent Number: 4,983,502

[45] Date of Patent: Jan. 8, 1991

[54] HEAT DEVELOPING PHOTOSENSITIVE MATERIAL

[75] Inventors: Keiji Ohbayashi; Tawara Komamura; Sohei Goto; Hidenobu Ohya, all of Hino, Japan

[73] Assignee: Konica Corporation, Tokyo, Japan

[21] Appl. No.: 312,895

[22] Filed: Feb. 17, 1989

[30] Foreign Application Priority Data

Feb. 23, 1988 [JP] Japan ..... 63-39950
Aug. 17, 1988 [JP] Japan ..... 63-205228

[51] Int. Cl.[5] ..... G03C 5/54; G03C 1/40

[52] U.S. Cl. ..... 430/353; 430/203; 430/559; 430/566; 430/617

[58] Field of Search ..... 430/203, 617, 566, 559, 430/353

[56] References Cited

U.S. PATENT DOCUMENTS 4,536,467 8/1985 Sakaguchi et al. ..... 430/559

*Primary Examiner*—Paul R. Michl
*Assistant Examiner*—Thorl Chea
*Attorney, Agent, or Firm*—Jordan B. Bierman

[57] ABSTRACT

A heat developing photosensitive material is disclosed, comprising silver halide, a binder, a reducing agent and a heat solvent, wherein said heat solvent is at least one selected from the group consisting of compounds represented by Formulae I, II and III:

I

II

III

26 Claims, No Drawings

HEAT DEVELOPING PHOTOSENSITIVE MATERIAL

FIELD OF THE INVENTION

The present invention relates to a heat developing photosensitive material capable of forming dyes or the like by heat development. The heat developing photosensitive material of the present invention can effectively be applied to a process of producing images where dyes formed by heat developing are diffused and transferred onto, for example, an image-receiving layer. More particularly, the present invention is concerned with a heat developing photosensitive material containing a novel heat solvent, and which is capable of producing images with an increased maximum density.

BACKGROUND OF THE INVENTION

It is known to those skilled in the art that there are heat developing photosensitive materials which enable images to be produced rapidly and readily by performing development in a dry process by heating. Such photosensitive materials and processes of producing images by the use thereof are disclosed, for example, in Japanese Patent Examined Publication Nos. 4921/1968 and 4924/1968, Fundamentals of Photographic Technology (Silver Salt Photography. Pages 553-555, Corona Publishing, 1979), and Research Disclosure No. 17029 (hereinafter abbreviated as RD. Pages 9–15, June 1978) and the like.

Generally, heat developing photosensitive materials can be divided into two groups, i.e., those which produce monochrome images and those which produce color images. Recently, studies have been made on the development of a heat developing color photosensitive material which produces color images by the use of dye-producing substances.

There have heretofore been proposed various processes of producing color images by using a heat developing color photosensitive material. Among them, there is a process in which color images are obtained by forming or releasing diffusible dyes by heat development, and the thus formed dyes are transferred onto an image-receiving element (this process will hereinafter be referred to as "transferring process"). This process, though it requires the use of an image-receiving element, is considered to be excellent in respect to the stability and vividness of obtained images, the simplicity of the developing procedure, as well as the accelerated development.

This kind of photosensitive material and the above-mentioned transferring process are disclosed, for example, in Japanese Patent Publication Open to Public Inspection (hereinafter referred to as Japanese Patent O.P.I. Publication) Nos. 12431/1975, 159159/1984, 181345/1984, 229556/1984, 2950/1985, 52643/1986, 61158/1986, 61157/1986, 180550/1985, 132952/1986, 139842/1986, U.S. Pat. Nos. 4,595,652, 4,590,154, and 4,584,367.

To promote heat development, heat solvents are often added to a photosensitive material. Especially in the case of the above-mentioned heat developing photosensitive material, various heat solvents or solvents are added to a photosensitive layer and/or non-photosensitive layer of the photosensitive material in order to attain a higher diffusible-dye forming efficiency or to improve dye-transferring efficiency.

The conventional heat solvents are roughly divided into two groups, i.e., solvents which are liquid at room temperature and solvents which are solid at room temperature but liquify when heat development is effected and exhibit various functions of a heat solvent. The representative examples of the former type of solvent include alcohols, polyols, phenols and ureas or amides of relative low molecular weight. However, this type of heat solvent is defective and, hence, is not suited to practical use: Specifically, many solvents of this kind are hygroscopic, and since they are present in liquid form in the photosensitive layer, they tend to make the photosensitive layer sticky. Further, the use of solvents of this kind inevitably causes photosensitive materials to adhere to each other or adhere to other materials.

On the other hand, in the case of the latter type of solvent, which is solid at room temperature, the above problems are eliminated to a considerable extent. As examples of this type of solvent, there can be mentioned compounds disclosed in Japanese Patent O.P.I. Publication Nos. 136645/1987, 232547/1985 and 53548/1988.

Meanwhile, the heat solvent which is solid at room temperature is required to be free not only from the above-mentioned problems of adhesion, but also from other problems concerning physical properties. For instance, heat solvents of this kind are required to exhibit the following advantageous properties:

(1) They do not volatilize nor gasify during the storage of a photosensitive material and during the process of heat development.

(2) They stably exist in the form of dispersed fine solid particles during the preparation of a photosensitive material.

(3) They retain their stable state of dispersed fine particles throughout the process of preparing a photosensitive material, and do not agglomerate.

(4) They do not exert any adverse effect on a hardened binder layer.

It is needless to say that, besides the above-mentioned properties, the heat solvent is required to play its essential role, i.e., to promote development as well as to increase the transferring efficiency of diffusible dyes.

However, all of the conventional heat solvents are unsatisfactory with respect to the above-mentioned properties. Under such circumstances, there is a strong demand in the art for a heat solvent which minimizes the above-mentioned problems.

SUMMARY OF THE INVENTION

It is, therefore, an object of the present provide a heat developing photosensitive material of enhanced heat developability and dye transferability.

It is another object of the present invention to provide a heat developing photosensitive material of excellent storability.

It is yet another object of the present invention to provide a heat developing photosensitive material containing a heat solvent which does not volatilize nor gasify during heat development.

It is a further object of the present invention to provide a heat developing photosensitive material in which a heat solvent exists stably in the form of dispersed solid particles during the storage of the photosensitive material and during heat development.

It is a still further object of the present invention to provide a heat developing photosensitive material containing a heat solvent which does not exert any adverse effect on a hardened binder layer.

DETAILED DESCRIPTION OF THE INVENTION

The present inventors made extensive studies to attain the above objects, and as a result, have found that the above-mentioned objects of the present invention can be accomplished by the following arrangement.

That is, the objects of the present invention can be attained by a heat developing photosensitive material comprising at least one compound selected from the group of compounds represented by Formulae I, II and III.

The present invention will be described in more detail hereunder.

First, an explanation will be made on a compound represented by Formulae I, II and III.

Formulae I, II and III are as follows:

Formula I

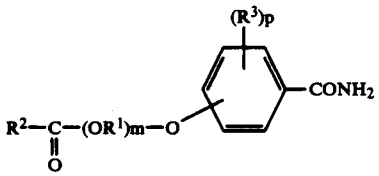

Formula II

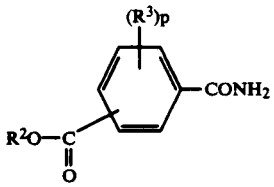

Formula III

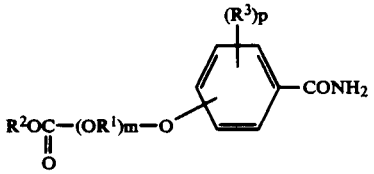

Wherein $R^1$ represents an alkylene group; $R^2$ represents an alkyl group, an alkenyl group or an aryl group, each of which may either be substituted or unsubstituted; $R^3$ represents an alkyl group, an alkoxy group, an aryl group, an aryloxy group, each of which may either be substituted or unsubstituted, a halogen atom, or a $CONH_2$ group; p represents an integer of 0 to 4 and when p is 2 or more, $R^3$ may be identical or may differ from each other; m represents 0, 1 or 2.

In the above formula, $R^1$ stands for an alkylene group. As the alkylene group, it is preferable to use an alkylene group having a carbon number of 2 to 4. The specific examples of this group include $$-CH_2CH_2-,\ -CH_2CH_2CH_2-,\ -(CH_2)_4-,\ -\overset{\overset{\displaystyle CH_3}{|}}{C}HCH_2-$$

$R^2$ stands for an alkyl group, an alkenyl group or an aryl group, each of which may either be substituted or unsubstituted. As the alkyl group for $R^2$, it is preferable to employ an alkyl group having a carbon number of 1 to 6.

The specific examples of the alkyl group include a methyl group, an ethyl group, an n-propyl group, an i-propyl group, an n-butyl group, an i-butyl group, a t-butyl group, a sec-butyl group and an n-hexyl group.

As the alkenyl group for $R^2$, it is preferable to use an alkenyl group having a carbon number of 2 to 6. Specific examples of the alkenyl group include a vinyl group, an allyl group and a 2-butenyl group.

As a preferred example of an aryl group for $R^2$, there can be mentioned a phenyl group.

The examples of the suitable substituent of $R^2$ include an alkyl group (e.g. a methyl group, an ethyl group), a phenyl group, an alkoxy group (e.g. a methoxy group, an ethoxy group, a n-butoxy group), a phenoxy group or a halogen atom (e.g. fluorine, chlorine, bromine.)

$R^3$ represents an alkyl group, an aryl group, an alkoxy group, an aryloxy group, each of which may either be substituted or unsubstituted, a halogen atom (preferably, fluorine, chlorine), or $CONH_2$ group. As the alkyl group, there can be preferably employed an alkyl group having a carbon number of 1 to 5 (e.g. a methyl group, an ethyl group, a n-butyl group). As the aryl group, there can preferably be employed a phenyl group. As the alkoxy group, it is preferable to use an alkoxy group having a carbon number of 1 to 5 (e.g. a methoxy group, an ethoxy group, a n-butoxy group.) As the aryloxy group, the use of a phenoxy group is preferred.

As the suitable substituent for these groups, there can be mentioned an alkyl group (e.g. a methyl group, an ethyl group), a phenyl group, an alkoxy group (e.g. a methoxy group, an ethoxy group), a phenoxy group or a halogen atom (e.g. fluorine, chlorine.)

The specific examples of the compound represented by Formula I, II or III, and which can advantageously be used in the present invention, will be given hereinafter.

However, the compound to be used in the present invention is not limited to those given below. Each example of this compound is given by specifying the position of a substituent and $R^1$, $R^2$, $R^3$, n and p.

Examples of Compounds Represented by Formula I

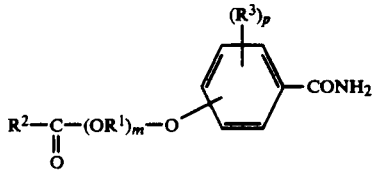

| Compound No. | Position of Substitution | ($R^1$) | ($R^2$) | ($R^3$) | (m) | (p) |
|---|---|---|---|---|---|---|
| TS-1 | 4-position | — | $C_2H_5$— | — | 0 | 0 |
| TS-2 | 4-position | — | i-$C_3H_7$— | — | 0 | 0 |
| TS-3 | 4-position | — | n-$C_4H_9$— | — | 0 | 0 |

-continued

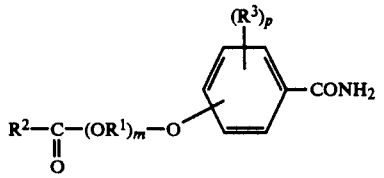

| Compound No. | Position of Substitution | ($R^1$) | ($R^2$) | ($R^3$) | (m) | (p) |
|---|---|---|---|---|---|---|
| TS-4 | 2-position | — | $C_2H_5$— | — | 0 | 0 |
| TS-5 | 3-position | — | $C_2H_5$— | — | 0 | 0 |
| TS-6 | 3-position | — | i-$C_3H_7$— | — | 0 | 0 |
| TS-7 | 3-position | — | $CH_3$— | — | 0 | 0 |
| TS-8 | 3-position | — | t-$C_4H_9$— | — | 0 | 0 |
| TS-9 | 4-position | — | $C_2H_5OCH_2Ch_2$— | — | 0 | 0 |
| TS-10 | 3-position | — | $CH_3OCH_2CH_2$— | — | 0 | 0 |
| TS-11 | 4-position | — | $C_2F_5$— | — | 0 | 0 |
| TS-12 | 3-position | — | $CCl_3$— | — | 0 | 0 |
| TS-13 | 4-position | —$CH_2CH_2$— | n-$C_4H_9$— | — | 1 | 0 |
| TS-14 | 4-position | —$CH_2CH_2$— | $CF_3$— | — | 1 | 0 |
| TS-15 | 4-position | —$CH_2CH_2$— | n-$C_3H_7$— | — | 1 | 0 |
| TS-16 | 4-position | —$CH_2CH_2$— | i-$C_3H_7$— | — | 1 | 0 |
| TS-17 | 4-position | —$CH_2CH_2$— | $Ch_3OCH_2CH_2$— | — | 1 | 0 |
| TS-18 | 4-position | —$CH_2CH(CH_3)$— | —$C_2H_5$— | — | 1 | 0 |
| TS-19 | 4-position | —$CH_2CH(CH_3)$— | n-$C_3H_7$— | — | 1 | 0 |
| TS-20 | 4-position | —$CH_2CH_2CH_2$ | $CH_3$— | — | 1 | 0 |
| TS-21 | 3-position | —$CH_2CH_2$— | $C_2H_5$— | — | 1 | 0 |
| TS-22 | 3-position | —$CH_2CH_2$— | $CH_3$— | — | 1 | 0 |
| TS-23 | 3-position | —$CH_2CH_2$— | n-$C_6H_{13}$— | — | 1 | 0 |
| TS-24 | 3-position | —$CH_2CH_2$— | $CH_3OCH_2CH_2$— | — | 1 | 0 |
| TS-25 | 3-position | —$CH_2CH_2$— | $C_3F_7$— | — | 1 | 0 |
| TS-26 | 3-position | —$CH_2CH_2$— | i-$C_3H_7$— | — | 1 | 0 |
| TS-27 | 3-position | —$CH_2CH_2$— | $C_6H_5$— | — | 1 | 0 |
| TS-28 | 3-position | —$CH_2CH_2$— | $CH_2 = CHCH_2$— | — | 1 | 0 |
| TS-29 | 3-position | —$CH_2CH_2(CH_3)$— | $C_2H_5$— | — | 1 | 0 |
| Ts-30 | 3-position | —$CH_2H_2$ | $CH_3$— | — | 2 | 0 |
| TS-31 | 3-position | — | $C_6H_5$— | — | 0 | 0 |
| TS-32 | 3-position | — | $C_6F_5$— | — | 0 | 0 |
| TS-33 | 3-position | — | $CH_3$—$C_6H_4$ | — | 0 | 0 |
| TS-34 | 4-position | — | $CH_2$=$CHCH_2$— | — | 0 | 0 |
| TS-35 | 3-position | — | $C_6H_5CH_2$— | — | 0 | 0 |
| TS-36 | 3-position | — | $CH_3OC_6H_5$— | — | 0 | 0 |
| TS-37 | 3-position | — | $C_2H_5$— | $CH_3$ Substituted at 5-position | 0 | 1 |
| TS-38 | 3-position | — | $C_2H_5$— | $CH_3$ Substituted at 5-position | 0 | 1 |
| TS-39 | 3-position | — | $C_2H_5$— | $CH_3$ Substituted at 5-position | 0 | 1 |
| TS-40 | 4-position | — | $C_2H_5$— | $CH_3$ Substituted at 2-position | 0 | 1 |
| TS-91 | 4-position | —$CH_2CH_2$— | $CH_2CH_2F$— | — | 1 | 0 |
| TS-92 | 4-position | —$CH_2CH(CH_2)$— | $CH_2CH_2Cl$— | — | 1 | 0 |
| TS-93 | 4-position | —$CH_2CH_2$— | $CH_3CH_2Br$— | — | 1 | 0 |
| TS-94 | 4-position | —$CH_2CH_2$— | $CH_2CH_2CH_2F$ | Cl 2-position | 1 | 1 |
| TS-95 | 3-position | —$CH_2CH_2$— | $CH_2CH_2CH_2Cl$— | — | 1 | 0 |
| TS-96 | 4-position | —$CH_2CH_2$— | $CH_2CH_2CH_2Br$ | — | 1 | 0 |
| TS-97 | 3-position | — | $CHClCH_2Cl$ | — | 0 | 0 |
| TS-98 | 4-position | — | $CH_2CHClCH_3$ | — | 0 | 0 |

Examples of Compounds Represented by Formula II

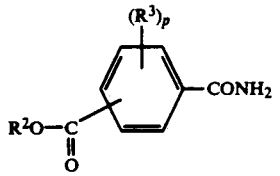

| Compound No. | Position of substitution | ($R^2$) | ($R^3$) | (p) |
|---|---|---|---|---|
| TS-41 | 4-position | n-$C_4H_9$— | — | 0 |
| TS-42 | 4-position | $C_2H_5$— | — | 0 |
| TS-43 | 4-position | $CH_3CH_2OCH_2CH_2$— | — | 0 |
| TS-44 | 4-position | i-$C_3H_7$ | — | 0 |
| TS-45 | 3-position | $CH_3$— | — | 0 |
| TS-46 | 3-position | $C_2H_5$— | — | 0 |
| TS-47 | 3-position | n-$C_3H_7$ | — | 0 |
| TS-48 | 3-position | $C_2F_5$— | — | 0 |
| TS-49 | 3-position | $C_2H_5$— | — | 0 |
| TS-50 | 3-position | $CH_2$=$CHCH_2$— | — | 0 |
| TS-51 | 3-position | n-$C_4H_9$ | — | 0 |
| TS-52 | 3-position | $CH_3OCH_2CH_2$— | — | 0 |
| TS-53 | 3-position | i-$C_3H_7$ | — | 0 |
| TS-54 | 3-position | t-$C_4H_9$— | — | 0 |
| TS-55 | 4-position | $C_3F_7$— | — | 0 |

-continued

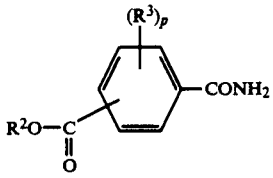

| Compound No. | Position of substitution | ($R^2$) | ($R^3$) | (p) |
|---|---|---|---|---|
| TS-56 | 4-position | $CH_2$=$CHCH_2$ | — | 0 |
| TS-57 | 2-position | n-$C_4H_9$— | — | 0 |
| TS-58 | 3-position | $C_2H_5$— | 5-position.$C_2H_5$ | 1 |
| TS-59 | 3-position | $C_2H_5$— | 5-position.Cl | 1 |
| TS-60 | 2-position | n-$C_4H_9$ | 4-position.$CONH_2$ | 1 |
| TS-99 | 4-position | —$CH_2CH_2Cl$ | — | 0 |
| TS-100 | 4-position | —$CH_2CH_2Br$ | — | 0 |
| TS-101 | 3-position | —$CH_2CHCl_2$ | — | 0 |
| TS-102 | 4-position | —$CH_2CHCl_3$ | 2-position.$CH_3$ | 1 |
| TS-103 | 4-position | —$CH_2CH_2CF_3$ | — | 0 |
| TS-104 | 3-position | —$CH_2CH_2CH_2Cl$ | — | 0 |
| TS-105 | 4-position | —$CH_2CH_2CH_2Br$ | — | 0 |
| TS-106 | 4-position | —$CH_2CH_2CH_2CH_2Cl$ | — | 0 |
| TS-107 | 4-position | —$CH_2CCl_2CHClCH_3$ | — | 0 |

Examples of Compounds Represented by Formula III

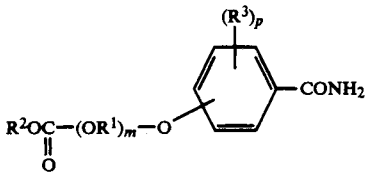

| Compound No. | Position of Substitution | ($R^2$) | ($R^1$) | ($R^3$) | (m) | (p) |
|---|---|---|---|---|---|---|
| TS-61 | 4-position | i-$C_3H_7$— | — | — | 0 | 0 |
| TS-62 | 4-position | $C_2H_5$— | — | — | 0 | 0 |
| TS-63 | 4-position | n-$C_3H_7$ | — | — | 0 | 0 |
| TS-64 | 4-position | n-$C_4H_9$— | — | — | 0 | 0 |
| TS-65 | 4-position | $CH_3OCH_2CH_2$— | — | — | 0 | 0 |
| TS-66 | 4-position | $C_2F_5$ | — | — | 0 | 0 |
| TS-67 | 3-position | $CH_3$ | — | — | 0 | 0 |
| TS-68 | 3-position | $C_2H_5$— | — | — | 0 | 0 |
| TS-69 | 3-position | n-$C_3H_7$ | — | — | 0 | 0 |
| TS-70 | 3-position | i-$C_3H_7$— | — | — | 0 | 0 |
| TS-71 | 3-position | sec-$C_4H_9$ | — | — | 0 | 0 |
| TS-72 | 3-position | $C_2H_5OCH_2CH_2$ | — | — | 0 | 0 |
| TS-73 | 3-position | $C_2H_5$— | — | 5-position.$CH_3$ | 0 | 1 |
| TS-74 | 3-position | n-$C_3H_7$ | — | — | 0 | 0 |
| TS-75 | 2-position | n-$C_4H_9$— | — | — | 0 | 0 |
| TS-76 | 4-position | i-$C_3H_7$ | —$CH_2CH_2$— | — | 1 | 0 |
| TS-77 | 4-position | $C_2F_5$— | —$CH_2CH_2$— | — | 1 | 0 |
| TS-78 | 4-position | n-$C_2F_5$— | —$CH_2CH_2$— | — | 1 | 0 |
| TS-79 | 4-position | $C_2H_5$— | —$CH_2CH$(—$CH_3$)— | — | 1 | 0 |
| TS-80 | 4-position | $C_2H_5$ | —$CH_2CH_2CH_2$— | — | 1 | 0 |
| TS-81 | 4-position | $CH_3$— | —$CH_2CH_2CH_2CH_2$— | — | 1 | 0 |
| TS-82 | 3-position | $C_2H_5$— | —$CH_2CH_2$— | — | 1 | 0 |
| TS-83 | 3-position | i-$C_3H_7$ | —$CH_2CH_2$— | — | 1 | 0 |
| TS-84 | 3-position | n-$C_3H_7$ | —$CH_2CH_2$— | — | 1 | 0 |
| TS-85 | 3-position | $C_2F_5$— | —$CH_2CH_2$— | — | 1 | 0 |
| TS-86 | 3-position | $C_2H_5$— | —$CH_2CH$(—$CH_3$)— | — | 1 | 0 |
| TS-87 | 3-position | $C_2H_5$ | —$CH_2CH_2CH_2$— | — | 1 | 0 |

-continued

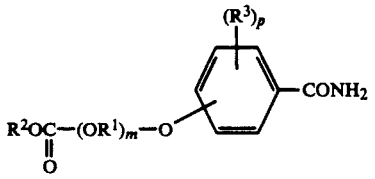

| Compound No. | Position of Substitution | ($R^2$) | ($R^1$) | ($R^3$) | (m) | (p) |
|---|---|---|---|---|---|---|
| TS-88 | 3-position | 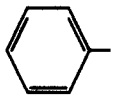 | $-CH_2CH_2-$ | — | 1 | 0 |
| TS-89 | 3-position | $CH_3-$ | $-CH_2CH_2-$ | — | 1 | 0 |
| TS-90 | 3-position | $C_2H_5-$ | $-CH_2CH_2-$ | 5-position.$Ch_3$ | 1 | 1 |
| TS-108 | 4-position | $-CH_2CH_2-$ | $-CH_2CH_2Cl-$ | 2-position.$CH_3$ | 1 | 1 |
| TS-109 | 4-position | $-CH_2CH_2$ | $-CH_2CH_2Br$ | — | 1 | 0 |
| TS-110 | 3-position | $-CH_2CH_2-$ | $-CH_2CHCl_2$ | — | 1 | 0 |
| TS-111 | 4-position | $-CH_2CH_2-$ | $-CH_2CHClCH_3$ | — | 1 | 0 |
| TS-112 | 4-position | $-CH_2CH_2-$ | $-CH_2CH_2CF_3$ | 2-position.Cl | 1 | 1 |
| TS-113 | 4-position | $-CH_2CH_2-$ | $-CH_2CH_2CH_2Cl$ | — | 1 | 0 |
| TS-114 | 4-position | $-CH_2CH_2-$ | $-Ch_2CH_2CH_2Br$ | — | 1 | 0 |
| TS-115 | 3-position | $-CH_2CH(CH_3)-$ | $-CH_2CH_2CH_2Cl$ | — | 1 | 0 |
| TS-116 | 4-position | — | $-CH_2CCl_2CHClCH_3$ | — | 0 | 0 |

Next, the processes for preparing some of the above-listed compounds will be explained below:

(1) Synthesis of TS-15

36.2 g of p-2-hydroxyethyloxybenzamide was dissolved in 200 ml of N,N-dymethylformamide, followed by the addition of 35 g of butyric anhydride. The resulting mixture was stirred while heated for one hour. The thus obtained reaction mixture was poured into water, followed by filtration to obtain a solid precipitate.

By recrystalization from ethanol, 52 g of the desired product was obtained (melting point: 102.5° C.)

(2) Synthesis of TS-43 p-cyanoacetic acid and 2-ethoxyethanol were subjected to an esterification reaction in benzene with p-toluenesulofonic acid as a catalyst, thereby to obtain p-cyanobenzoic-2-ethoxyethyl ester. To 50 g of the above product, were added 10 g of 30% potassium hydroxide and 50 ml of hydrogen peroxide solution. The resulting mixture was allowed to hydrolize at 30° C, and the desired product was obtained (melting point: 109° C.)

(3) Synthesis of TS-65

13.7 g of p-2-hydroxybenzamide was dissolved in 100 ml of pyridine. 14 g of 2-methoxyethyl chloroformate was added dropwise at room temperature. After the addition, the mixture was stirred, and then poured into ice water. A precipitate was filtered, washed with water and dried. By recrystalization from ethanol, 19.8 g of the desired product was obtained (melting point: 120.5° C.)

The compounds represented by Formulae I, II and III (hereinafter often referred to as "the solid heat solvent of the present invention" or "the heat solvent of the present invention") should have a melting point of 80° C to 200° C, more preferably 100° C to 180° C.

The heat solvent of the present invention is added preferably in an amount of 20 to 500% by weight, more preferably 40 to 250% by weight, of the total amount of binder in the heat developing photosensitive material.

The heat solvent in the foregoing description can be added to all of the photographic layers constituting the heat developing photosensitive material of the present invention. Alternatively, it can be added to some of these layers; for example, to a photosensitive silver halide emulsion layer, an intermediate layer and a protective layer.

The heat solvent of the present invention is not readily soluble in water. Therefore, it is preferable that the heat solvent of the present invention be employed in the form of a suspension obtained by grinding it into fine particles by means of a ball mill or a side mill, and dispersing the particles into an aqueous medium to form a colloidal solution.

The heat solvent of the present invention can be used alone or in combination.

According to the heat developing photosensitive material of the present invention, other conventional heat solvents which are outside the range of the present invention can be employed in combination with the heat solvent of the present invention. When such conventional solvents are used, the heat solvent of the present invention is used in an amount of 50% or more, more preferably 70% or more, of the total amount of the heat solvents employed.

As explained heretofore, the heat developing photosensitive material of the present invention is capable of producing dyes or the like by heat development, thus enabling images to be produced.

Generally, this kind of heat developing photosensitive material should preferably have a structure in which, on a support, there is provided at least one photosensitive layer containing a photosensitive silver halide, a reducing agent, a binder, and, if necessary, a dye-providing substance.

In this type of photosensitive material, images can be produced therein only by subjecting it to heat treatment after imagewise exposure. When the transferring process is employed, the photosensitive material and an image-receiving element are laid one upon another at the time of or after heat development, thus allowing transferable compounds such as dyes to transfer onto the image-receiving layer of the image-receiving elements. According to the present invention, preferable results can be obtained when the heat developing photosensitive material is applied t the transferring process.

There are no restrictions as to the kind of silver halide to be used in the present invention. For example, silver chloride, silver bromide, silver iodide, silver chlorobromide, silver chloro-iodide and silver bromo-iodide are usable.

The shape of said silver halide can be selected without any specific restrictions. For instance, cubic, spherical, octahedral or dodecahedral silver halide can be employed. The average grain size of said silver halide is 0.05 μm to 2 μm, more preferably 0.08 μm to 0.5 μm. The grain size may be either monodispersed or polydispersed.

To attain enhanced sensitivity, the silver halide to be used in the present invention should preferably be treated with chemical sensitizers such as noble metals, sulfur, and reducing compounds.

Also, if necessary, the silver halide may be spectrally sensitized by a known spectral sensitization dye.

With respect to the reducing agent to be used in the heat developing photosensitive material of the present invention (precursors of reducing agents are included in the reducing agent referred to in this specification), there can be employed reducing agents which have conventionally been used in ordinary heat developing photosensitive materials. Examples of the reducing agent for use in the present invention include developing agents of the types of p-phenylenediamine and p-aminophenol, developing agents of the types of phosphoroamidophenol and sulfonamidoaniline, color developing agents of the hydrazone type and precursors thereof, phenols, sulfonamidophenols, polyhydroxybenzene, naphthols, hydroxybisnaphthyls, methylenebisnaphthols, methylenebisphenols, ascorbic acid, 3-pyrazolidone, and pyrazolones. These reducing agents are described in, for example, U.S. Pat. Nos. 3,531,286, 3,761,270, and 3,764,328, RD Nos. 12146, 15108, and 15127, Japanese Patent O.P.I. Publication No. 27132/1981, U.S. Pat. Nos. 3,342,599 and 3,719,492, and Japanese Patent O.P.I. Publication Nos. 135628/1978 and 79035/1982.

As the especially preferred example of the reducing agent, there can be mentioned a salt of N-(p-N,N-dialkylamino)phenylsulfamic acid described in Japanese Patent O.P.I. Publication Nos. 146133/1981 and 227141/1987.

The specific examples of the reducing agent which can advantageously be used in the present invention will be given below.

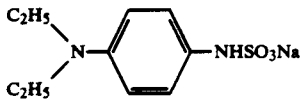

(R-1)

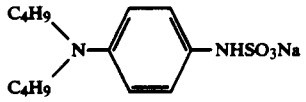

(R-2)

-continued

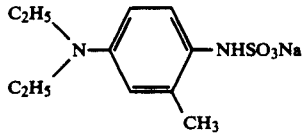

(R-3)

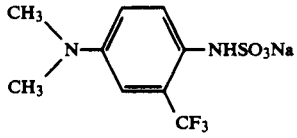

(R-4)

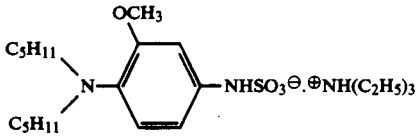

(R-5)

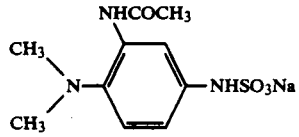

(R-6)

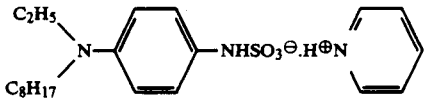

(R-7)

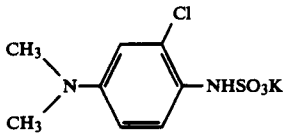

(R-8)

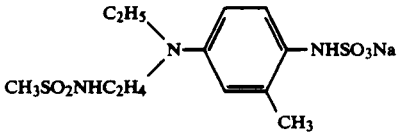

(R-9)

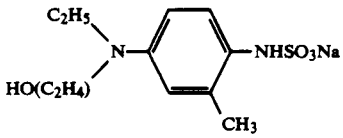

(R-10)

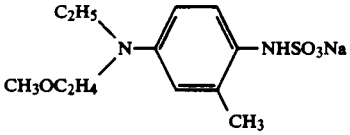

(R-11)

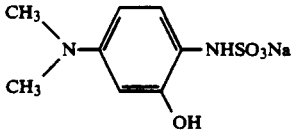

(R-12)

-continued
(R-13)
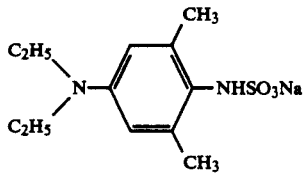
(R-14)
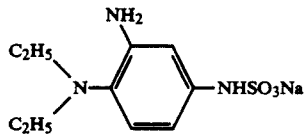
(R-15)
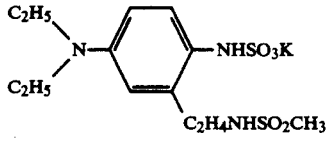
(R-16)
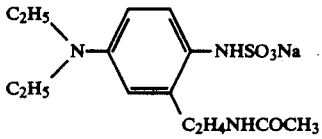
(R-17)
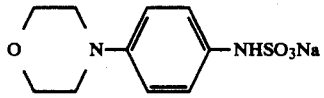
(R-18)
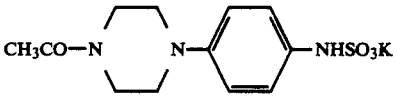
(R-19)
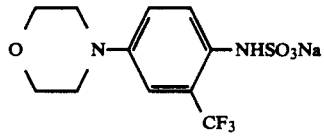
(R-20)
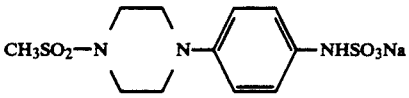
(R-21)
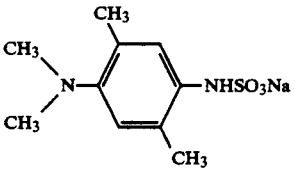
(R-22)
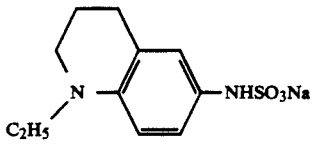
-continued
(R-23)
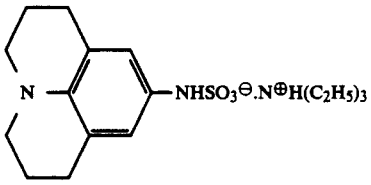
(R-24)
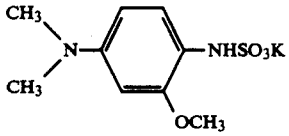
(R-25)
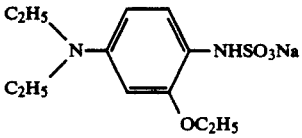
(R-26)
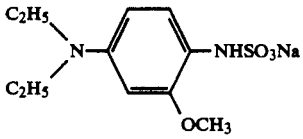
(R-27)
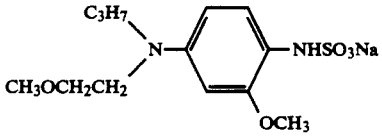
(R-28)
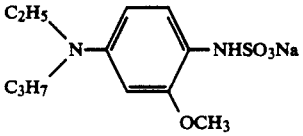
(R-29)
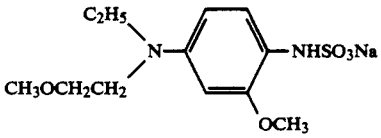
(R-30)
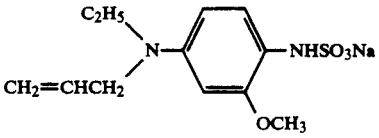
(R-31)
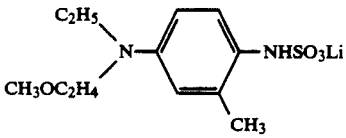
(R-32)
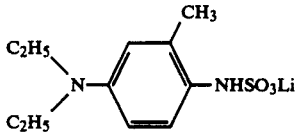

-continued

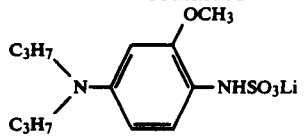

(R-33)

The reducing agents as listed above should be employed in an amount of 0.01 to 10 moles, more preferably 0.1 mole to 5 moles per mole photosensitive silver halide.

As a dye-providing substance applicable to the heat developing photosensitive materials of the present invention, use can be made of, for example, couplers for forming non-diffusible dyes disclosed in Japanese Patent O.P.I. Publication Nos. 44737/1987, 129852/1987 and 169158/1987, leuco dyes disclosed in U.S. Pat. No. 475,441, and azo dyes for use in the heat developing dye-bleaching method disclosed in U.S. Pat. No. 4,235,957. However, it is preferable to use diffusion type dye-providing substances which form or release diffusible dyes. The especially preferred are compounds which are capable of forming diffusible dyes by coupling.

A description will now be given o the diffusion type dye-providing substances applicable to the present invention. A compound to be used as the diffusion type dye-providing substance is required to be one which takes part in the reduction of the photosensitive silver halide and/or the organic salt which is used if need arises so that it can form or release a diffusible dye as a function of the reaction. Such a diffusion type dye-providing substance can be divided into two groups according to the mode of reaction. The dye-providing substances belonging to one of these groups are those of the negative type which react as a positive function, forming negative dye images where silver halides of the negative type are used. The dye-providing substances belonging to the other group are those of the positive type which react as a negative function, forming positive dye images where silver halides of the negative type are used.

The examples of the dye providing substance of the negative type are the dye-releasing reductive compounds disclosed in U.S. Pat. Nos. 4,463,079 and 4,439,513, Japanese Patent O.P.I. Publication Nos. 60434/1984, 65839/1984, 71046/1984, 87450/1984, 88730/1984, 123837/1984, 124329/1984, 165054/1984, and 164055/1984. As another example of the negative type dye-providing substance, there can be mentioned a dye-releasing compound of the coupling type disclosed in U.S. Pat. No. 4,474,867, Japanese Patent O.P.I. Publication Nos. 12431/1984, 48765/1984, 174834/1984, 776642/1984, 159159/1984 and 231540/1984.

The especially preferred as the dye-providing substance of the negative type is a dye-forming compound of the coupling type represented by the following Formula a.

Formula a $$Cp—J—B)$$

Wherein Cp represents an organic group which is capable of forming a diffusible dye by reacting (coupling) with the oxidized product of a reducing agent. J represents a bonding group, and B stands for a ballast group. The ballast group as referred to herein is a group which substantially prevents the dye-providing substance from diffusing during the course of heat development. The examples of the ballast group include a sulfo group o the like which makes molecules assume this property and a group with a large carbon number or the like whose magnitude has this effect.

The coupler residue represented by Cp should be one with a molecular weight of 700 or less, more preferably 500 or less, in order to make the dye formed have good diffusibility.

The ballast group should be a group with a carbon number of 8 or more, more preferably 12 or more. When the image-receiving layer consists of a hydrophobic binder, said ballast group may be sulfo group. In this case, more satisfactory is the use of a group containing both a sulfo group and an alkyl group having a carbon number of 8 or more (preferably 12 or more), and most satisfactory is the use of a ballast group containing a polymer chain.

Such a dye-forming compound of the coupling type containing a polymer chain group should preferably be one containing as a ballast group a polymer chain which consists of repeating units derived from a monomer as represented by the following Formula b:

Formula b $$Cp—J—Y)_l(Z'a—L)$$

In this formula, Cp and J are as defined in Formula a, and Y represents an alkylene group, an arylene group or an aralkylene group, and l denotes 0 or 1, Z' a divalent organic group, and L an ethylenic unsaturated group or a group containing an ethylenic unsaturated group.

The examples of the dye-forming compounds of the coupling type represented by said Formulae a and b include compounds disclosed in Japanese Patent O.P.I. Publication Nos. 124339/1984, 181345/1984, 2950/1985, 57943/1985, 59336/1985, U.S. Pat. Nos. 4,631,251, 4,650,748 and 4,656,124, the dye-forming materials of the polymer type in the last-mentioned three U.S. Pats are preferable.

The examples of the dye-providing substances of the positive type are dye-developing compounds, such as those disclosed in Japanese Patent O.P.I. Publication Nos. 55430/1984 and 165054/1984, compounds which release diffusible dyes by an intramolecular nucleophilic reaction, such as those disclosed in Japanese O.P.I. Publication Nos. 154445/1984 and 766954/1984, cobalt-complex compounds, such as those disclosed in Japanese Patent O.P.I. Publication No. 116655/1984, and compounds which are rendered unable to release dyes when oxidized, such as those disclosed in Japanese Patent O.P.I. Publication Nos. 124327/1984 and 152440/1984.

As the residue of the diffusible dye in the dye-providing substance usable in the present invention, there can advantageously be employed a residue with a molecular weight of 800 or less, more preferably 600 or less from a viewpoint of the diffusibility of a dye. The examples of such residue include dye residues of azo dyes, azomethine dyes, anthraquinone dyes, naphthoquinone dyes, styryl dyes, nitro dyes, quinoline dyes, carbonyl dyes, and phthalocyanine dyes. These dye residues may be present in a form whose spectral range is temporarily in the short wave side and which becomes visible by heat developing or transferring. In one preferred embodiment of the present invention, these residues are chelatable dye residues such as those described in Japanese Patent O.P.I. Publication Nos. 48765/1984 and 124337/1975.

These dye-providing substances may be used alone or in combination. The amount of such dye-providing substance may vary depending on such factors as what kind of dye-providing substance(s) is employed, whether the dye-providing substance is used singly or in combination, and whether the photosensitive layer has a single layer structure or a multi-layer structure. For example, in the present invention, the dye-providing substance can be employed in a amount of 0.005 to 50 g, preferably 0.1 to 10 g per square meter of the photosensitive material.

The binders applicable in the formation of the heat developing color photosensitive material of this invention include both synthetic and natural high polymer materials. The example of such binder include polyvinyl butyral, polyvinyl acetate, ethyl cellulose, polymethyl methacrylate, cellulose acetate butyrate, polyvinyl alcohol, polyvinyl pyrrolidone, gelatin, gelatin derivatives such as phthalated gelatin, cellulose derivatives, protein, starch, and gum arabic. These polymeric materials can be employed alone or in combination. According to the present invention, it is preferable that the binder consists mainly of gelatin.

Gelatin which is advantageously employed in the present invention is either alkaline-treated gelatin or acid-treated gelatin. According to the present invention, gelatin or a derivative thereof can be used in combination with a hydrophilic polymer such as polyvinyl pyrrolidone or polyvinyl alcohol.

According to the present invention, the binder is used in an amount of 0.3 to 30 g, more preferably 0.5 to 20 g per square meter of the support.

The binder is used in an amount of 0.1 to 10 g, more preferably 0.25 to 4 g per gram of the dye-providing substance.

In the present invention, to increase sensitivity and improve developability, various organic silver salts can be incorporated into the heat developing photosensitive material.

As examples of the organic silver salts usable in the present invention, there can be mentioned silver salts of long chain-aliphatic carboxylic acid, those of carboxylic acid having a heterocycle (e.g. silver laurate, silver myristate, silver palmitate, silver stearate, silver arachidonate, silver behenate, silver α-(1-phenyltetrazolthio)acetate, silver salts of aromatic carboxylic acid (e.g. silver benzoate, silver phthalate). These silver salts are described in, for example, Japanese Patent Examined Publication Nos. 4921/1978, 52626/1974, 141222/1977, 36224/1978, and 37610/1978, and U.S. Pat. Nos. 3,330,633, 3,794,496 and 4,105,451. Also usable are silver salts of imino groups, such as those described in Japanese Patent Examined Publication Nos. 26582/1969, 12700/1970, 18416/1970 and 22185/1970, Japanese Patent O.P.I. Publication Nos. 137321/1977, 118638./1983 and 118639/1983, and U.S. Pat. No. 4,123,274.

Use also can be made of complex silver compounds with a stability constant in the range of 4.5 to 10.0, such as those described in Japanese Patent O.P.I. Publication No. 31728/1977, and silver salts of imidazoline thione such as those described in U.S. Pat. No. 4,168,980.

Among all the organic silver salts mentioned above, preferable for use in the present invention are silver salts of imino groups, and especially preferable are silver salts of benzotriazole and its derivatives, such as 5-methylbenzotriazole and derivatives thereof, sulfobenzotriazole and its derivatives, and N-alkylsulfamoylbenzotriazole and its derivatives.

The organic silver salt to be used in the present invention can be used alone or in combination. The organic silver salt may be prepared in a suitable binder and put into use as it is without being isolated therefrom. Alternatively, the organic silver salt may be dispersed in a binder by a suitable method.

As explained before, according to the present invention, the heat solvent comprising at least one compound represented by Formulae I, II and III is added to the heat developing photosensitive material. When use is made of an image-receiving element in combination with the photosensitive material, it is preferable that the heat solvent of the present invention or other various known heat solvent are added to the image-receiving layer.

Besides the constituents in the foregoing description, the heat developing photosensitive material of the present invention may contain various known additives, if necessary. Examples of such additives include inorganic halides such as sodium chloride, potassium bromide, potassium chloride and potassium iodide. In one embodiment of the present invention, an aqueous solution of such inorganic halide is added to the photosensitive silver halide emulsion.

.The heat developing photosensitive material of the present invention may contain, as a developing accelerator, a substance known as a toning agent.

As the toning agent, there can be employed those described in Japanese Patent O.P.I. Publication Nos. 4928/1971, 6077/1971, 5019/1974, 5020/1974, 91215/1974, 107727/1974, 2524/1975, 67132/1975, 67641/1975, 114217/1975, 33722/1977, 99813/1977, 1020/1978, 55115/1978, 76020/1978, 125014/1978, 156523/1979, 1565324/1979, 156525/1979, 156526/1979, 4060/1980, 4061/1980, 32015/1979, German Patent Nos. 2,140,406, 2,141,063, 2,220,618, U.S. Pat. Nos. 3,847,612, 3,782,941, 4,201,582, and Japanese Patent O.P.I. Publication Nos. 207244/1982, 207245/1982, 1896328/1983 and 193541/1983

As other examples of the developing accelerator, there can be mentioned compounds described in Japanese Patent O.P.I. Publication Nos. 177550/1984 and 111636/1984. Also, use can be made of a developing accelerator-releasing compound described in Japanese Patent O.P.I. Publication No. 159642/1986.

As an anti-fogging agent, there can be employed a higher fatty acid described in U.S. Pat. No. 3,645,739, a mercuric salt described in Japanese Patent Examined Publication No. 11113/1972, an N-halide described in Japanese Patent O.P.I. Publication No. 7419/1979, a compound releasing a mercaptane compound described in U.S. Pat. No. Pat. No. 3,700,457 and Japanese Patent O.P.I. Publication No. 50725/1976, an arylsulfonic acid described in Japanese Patent O.P.I..Publication No. 125016/1974, a salt of lithium carbonate described in Japanese Patent O.P.I. Publication No. 47419/1976, an oxidation agent described in British Patent No. 1,455,271, and Japanese Patent O.P.I. Publication No. 101019/1975, sulfinic acids or thiosulfonic acids described in Japanese Patent O.P.I Publication No. 19825/1978, 2-thiouracils described in Japanese Patent O.P.I. Publication No.3223/1976, sulfur described in Japanese Patent O.P.I. Publication No. 26019/1976, disulfide or polysulfides described in Japanese Patent O.P.I. Publication Nos. 42529/1976, 81124/1976 and 93149/1980, rosin or diterpenes described in Japanese Patent O.P.I. Publication No.57435/1976, a polymeric acid containing a free carboxyl group or a sulfonic group described in Japanese O.P.I. Publication No. 104338/1976, thiazoline thione described in U.S. Pat. No. 4,138,265, 1,2,4-triazole or 5-mercapto-1,2,4-triazole described in Japanese Patent O.P.I, Publication No. 51821-1979 and U.S. Pat. No. 4,137,079, esters of thiousulfinic acids described in Japanese Patent O.P.I. Publication No. 140883/1980, 1,2,3,4-thiatriazole described in Japanese Patent O.P.I. Publication No. 142331/1980, dihalides or trihalides described in Japanese Patent O.P.I. Publication Nos. 46641/1984, 57233/1984, and 57234/1984, a thiol compound described in 111636/1984, a hydroquinone derivative described in Japanese Patent O.P.I. Publication No. 198540/1985. Also application to the present invention is a combination of a hydroquinone derivative and a benzotriazole derivative described in Japanese Patent O.P.I. Publication No. 227255/1985.

As other preferred examples of the anti-fogging agent, there can be mentioned an inhibitor containing a hydrophilic group described in Japanese Patent Application Specification No. 218169/1987, a polymerization inhibitor described in Japanese Patent O.P.I. Publication No 21452/1987 and an inhibitor compound containing a ballast group described in Japanese Patent O.P.I. Publication No. 263564/1985.

Further, the heat developing photosensitive material of the present invention may contain inorganic or organic base or a precursor thereof. As the suitable precursor, there can be used a compound which is decarbonized to release a basic substance (e.g. guanidium trichloroacetate) or a compound which is decomposed by a reaction such as an intramolecular nucleophilic substitution reaction to release an amine. Examples of these compounds can be found in Japanese Patent O.P.I. Publication No. 130745/1981, 132332/1981, British Patent No. 2,079,480, U.S. Pat. No. 4,060,420, Japanese Patent O.P.I. Publication No. 157637/1984, 166943/1984, 180537/1984, 174830/1984, and 195237/1984.

Besides the additives mentioned above, use can be made of various conventional photographic additives such as an anti-halation dye, an optical bleaching agent, an antistatic agent, a plasticizer, a spreader, a hardening agent, a matting agent, a surface-active agent, an anti-fading agent, or the like. Specific examples of these additives are introduced in RD No. 17029 (Vol. 170, June 1978) and described in Japanese Patent O.P.I. Publication No. 135825/1987.

The heat developing photosensitive material of the present invention has a structure in which at least one photosensitive layer is provided on a support. As the support usable in the present invention, there can be mentioned a synthetic film of polyethylene, cellulose acetate or polyethylene terephthalate, polyvinylchloride; a paper such as an original paper for photography or printing, a baryta paper, a resin-coated paper. Also usable is a support formed by coating the above-mentioned film or paper with an electron beam-setting resin.

The heat developing photosensitive material of the present invention is ordinarily of a structure in which one or more photosensitive layers are formed on a support. In the case of a full color photosensitive material, it is composed of three photosensitive layers differing from one another in color sensitivity. In each photosensitive layer, a dye having a hue different from that which formed or released in other layers is formed or released. Ordinarily, a yellow dye-providing substance is used in a blue-sensitive layer, a magenta dye-providing substance in a green-sensitive layer, and a cyan dye-providing material in a red-sensitive layer. But the heat developing photosensitive material according to the present invention is not limited to this combination. For example, a cyan dye-providing substance may be used in a blue-sensitive layer, a magenta dye-providing substance in a green-sensitive layer and a yellow dye-providing substance in a red-sensitive layer, or a cyan dye-providing substance may be used in a blue-sensitive layer, a yellow dye-providing substance in a green-sensitive layer and a magenta yellow dye-providing substance in a red-sensitive layer. A near infrared ray-sensitive layer may be provided, if necessary.

The arrangement of these layers can be selected according to the purpose without any specific restrictions. For example, the photosensitive material may be of a structure in which a red-sensitive layer, a green-sensitive layer and a blue-sensitive layer are laminated on a support in that sequence. The photosensitive material may also have a structure in which a blue-sensitive layer, a green-sensitive layer and a red-sensitive layer are laid one upon another in that sequence, or a structure in which a green-sensitive layer, a red-sensitive layer and a blue-sensitive layer are laid one upon another in that sequence.

In addition to the photosensitive layer(s) explained above, the heat developing photosensitive material of the present invention may be provided with a non-photosensitive layer(s), such as a base-coated layer, an intermediate layer, a protective layer, a filter layer, a backing layer or a peelable layer.

Various means for exposure are applicable to the heat developing color photosensitive material of the present invention. Among such means, preferable is imagewise exposure by radiant light including visible light. Examples of preferable light sources for imagewise exposure include tungsten lamps halogen lamps, xenon lamps mercury lamps laser light sources, CRT light sources, fluorescent tubes, and light-emitting diodes.

As the originals of the images recorded in the heat developing photosensitive material of the present invention, there can be used natural subjects, documents of both the reflective and transparent types, images in lines such as drawings and barcodes, photographic images and printed images of color film, color paper, etc. forming continuous graduations, image data photographed by video cameras or transmitted from TV stations, image data obtainable by computer graphics, and the like.

It is possible that two or more kinds of originals are subjected to light exposure, together or separately, on the same photosensitive material.

When the heat developing color photosensitive material of the present invention is exposed to light through an original image such as those mentioned above, the image data in blue, green and red of the original can be converted to the image data of the corresponding complementary colors (i.e., yellow, magenta and cyan); sometimes the negative-to-positive conversion is carried out simultaneously, in the same ordinary manner as in contact printing from negative color film to color paper or in the printing in enlargement; or the image data in blue, green and red of the original can also be converted to dye image data differing from the respective complementary colors.

After or simultaneously with the imagewise exposure, the development of the heat developing photosensitive material of the present invention is carried out simply by heating to a temperature of 80° C.-200° C., more preferably 100° C.-170° C. The development is effected for 1-180 seconds, more preferably 1.5-120 seconds. The transfer of the diffusible dyes to the image-receiving layer can be carried out by placing the image receiving layer in close contact with the photosensitive surface of the heat developing photosensitive material simultaneously with or after the heat development, or by placing the image-receiving layer in close contact with the photosensitive surface after the supply of water, followed by, if necessary, heating. The photosensitive material and the image-receiving element may be subjected to preliminary heating at a temperature of 70° C. to 180° C. before image exposure.

The photosensitive material of the present invention can be heated by various methods or means which are generally used for the heating of conventional heat developing photosensitive materials. For instance, heating can be effected by bringing the photosensitive material in contact with a heated block or a plate, or with a heated roller or a drum; or by passing it through an atmosphere of high temperature; or by effecting high frequency heating; or by providing a conductive layer containing a conductive substance such as carbon black on the backside of the photosensitive material or on that of the image-receiving element so that Joule heat generated by passing electricity therethrough can be utilized. The application of heat is not confined to any specific pattern; for example, it is practical to perform preheating before heat development; or to heat at a high temperature for a short time and at a low temperature for a long time; to apply heat in a continuous rise or in a continuous fall or in a fluctuating pattern; or to heat discontinuously. It is preferable to effect heating in a simple mode. Also heating can be carried out simultaneously with light exposure.

Heat development should be performed from 1 second to 24 hours, more preferably from 5 seconds to 12 hours, after the light exposure. However, when the light exposure and the heat development are performed by using the same device, the heat development should be performed from 1 second to 10 minutes, preferably from 2 seconds to 5 minutes, more preferably from 5 seconds to 2 minutes after the light exposure.

When the heat development photosensitive material of the present invention is applied to the transferring process, an image-receiving element is required to be used. The image-receiving layer of such image-receiving element may consist of either hydrophobic or hydrophilic material, and is only required to be able to receive dyes formed or released in the photosensitive layer of the heat developing photosensitive material. As a preferred example of the material for use in the image-receiving layer, there can be mentioned a polymer containing a tertiary amine or a quaternary ammonium salt as described in U.S. Pat. No. 3,709,690. As the polymer containing a quaternary ammonium salt, there can be employed copolystylene-N,N,N-tri-n-hexyl-N-vinylbenzyl ammonium chloride in which the ratio of the quaternary ammonium salt and the polymer is 1:4 to 4:1, preferably 1:1.

As the polymer containing a tertiary amine, there can be employed, for example, polyvinylpyridine. According to the present invention, the image-receiving layer may be formed by coating a support with a mixture of the polymer of the above kind (containing an ammonium salt or a tertiary amine) and substances such as gelatin and polyvinyl alcohol.

As the material constituting the image-receiving layer, it is especially preferable from a viewpoint of water durability that use is made of a heat-resistant organic high molecular compound having a glass transition temperature of 40° C. to 250° C., disclosed for example, in Japanese Patent O.P.I. Publication No. 20725/1982. The image-receiving layer may have a structure in which a layer consisting of the above-described polymer is formed on a support. Such polymer may also be utilized as a material constituting a support.

Examples of the heat-resistant organic high molecular substances include polystyrene, polystyrene derivatives containing a substituent with a carbon number of 4 or less, polyvinyl cyclohexane, polyvinyl benzene, polyvinyl pyrrolidone, polyvinyl carbazole, polyarylbezene, polyvinyl alcohol, polyacetals such as polyvinyl formal and polyvinyl butyral, polyvinyl chloride, chlorinated polyethylene, polytrichlorofluoroethylene, polyacrylonitrile, poly-N,N-dimethylaryl amide, polyacrylate containing p-cyanophenyl group, pentachlorophenyl group, and 2,4-dichlorophenyl group, polyacrylchloroacrylate, polymethyl, methacrylate, polyethyl methacrylate, polypropyl methacrylate, polyisopropyl methacrylate, polyisobutyl methacrylate, poly-tert-butyl, methacrylate, polycyclohexyl methacrylate, polyethylene glycol, dimethacrylate, poly-2-cyanoethyl, methacrylate, polyesters such as polyethylene, terephthalate, polysulfone, polycarbonates such as bisphenol A polycarbonate, polyanhydride, polyamides, and celluose acetates. The synthetic polymers having a glass-transition temperature of 540° C. or more as described in Polymer Handbook 2nd Ed. (Brandrup, J. and Immergut, E.H., Johe Wiley & Sons) are useful. These high molecular substances ordinarily have a molecular weight of 2,000 to 200,000. These high molecular substances may be used alone or in combination. Also, use can be made of a copolymer obtained by copolymerization of two or more of the above polymers.

Examples of useful polymers include cellulose acetate such as triacetate and diacetate; polyamides formed by combining heptamethylenediamine with terephthalic acid, fluorenedipropylamine with adipic acid, hexamethylenediamine with diphenic acid, hexamethylenediamine with isophthalic acid, and the like; polyesters formed by combining diethylene glycol with diphenylcarboxylic acid, bis-p-carboxyphenoxybutane with ethylene glycol, and the like; polyethylene terephthalate and polycarbonate.

Such polymers can be used in their modified form, an example of which is polyethylene terephthalate modified with cyclohexanedimethanol, isophthalic acid, or methoxypolyethylene-glycol, 1,2-dicarbomethoxy-4-benzenesulfonic acid.

The especially preferable image-receiving layer in the present invention consists of polyvinyl chloride as described in Japanese Patent O.P.I. Publication No. 223425/1984 or polycarbonate and a plasticizer as described in Japanese Patent O.P.I. Publication No. 19138/1985.

As a method for forming an image-receiving layer on a support, the solution-coating method is preferably employed from a viewpoint of ensured efficiency and reduced manufacturing cost.

A solvent to be used in such method can be selected, according to the kind of material constituting the support, from conventional organic solvents such as methylenechloride, methylethylketone and tetrahydrofurane.

If need arises, the image-receiving layer may contain such additives as an ultraviolet absorbent (e.g. benzotriazole-type compounds), a dye-image stabilizer (e.g. phenol-type compounds, bisphenol-type compounds, hydroquinone-type compounds, gallic acid derivatives, hydroxycumarone-type compounds, polyalkylpiperidine-type compounds, dialkoxybenzene type compounds, hydroxyindan type compounds), a plasticizer (e.g. dibutylphthalate, di-(2-ethylhexyl)phthalate, tricresyl phosphate), a development accelerator, a reducing agent, and a heat solvent.

The support of the image-receiving layer may either be transparent or opaque. For instance, use can be made of a film of polyethylene terephthalate, polycarbonate, polystyrene, polyvinyl chloride, polyethylene, and polypropylene. Also usable is a support formed by adding such a pigment as titanium oxide, barium sulfate, calcium carbonate or talc. The support may also consist of a pure baryta paper, an RC paper in which a thermoplastic resin containing a pigment is laid on a paper to form a laminate, and metal such as aluminum. Also the support of the above kind may be coated with an electron beam-setting resin containing a pigment, or it may be provided with thereon a coating layer containing a pigment. A cast-coated paper disclosed in Japanese Patent O.P.I. Publication No. 283333/1987 is also useful as the support.

When the heat developing photosensitive material of the present invention is used in the transferring process, the photosensitive material and the image-receiving element may be arranged in such a manner that all of the dye images formed in said photosensitive material can be transferred onto the entire surface or part of the image-receiving element, or alternatively, it may be arranged in such a manner that part of the dye images can be transferred onto the entire surface or part of the image-receiving layer. There is no restriction as to the size of heat developing photosensitive material and the image-receiving element. They may have the same size, or, to improve the peeling property of the image-receiving element, they may be prepared in different sizes. Further, it is not required that the phtosensitive material and the image-receiving element be in the same shape.

EXAMPLES

The present invention will be described in detail with reference to the following examples which are meant to be illustrative but not limitive.

Example 1

(1) Preparation of silver iodo-bromide emulsion

To Liquid A containing 20 g of ossein gelatin, 2,000 ml of an ion-exchange water and ammonia, were added, by means of a mixing stirrer disclosed in Japanese Patent O.P.I. Publication Nos. 92523/1982 and 92524/1982, 1,000 ml of an aqueous solution containing 5.8 g of potassium iodide and 233.2 g of potassium bromide (Liquid B) and 1,000 ml of an aqueous solution containing 2 moles of silver nitrate and 4 moles of ammonia (Liquid C), while maintaining pAg at a constant value.

The size and shape of granules of the emulsion to be prepared were controlled by adjusting pH, pAg, and the rate of adding Liquids B and C. Thus, a monodispersed silver iodo-bromide emulsion (the average grain size: 0.24 =m) with a silver iodo-bromide content of 2 mol% was obtained.

The so-formed emulsion is desalted, and adjusted to have a pAg of 6.8 at 40° C.. As a result, 1,400 ml of the emulsion of silver iodo-bromide was obtained.

(2) Preparation of photosensitive silver halide emulsions

To 700 ml of the above-obtained silver iode-bromide emulsion, the ingredients listed below were added in sequence. The resultant was chemically and spectrally sensitized, thereby to obtain a red-sensitive silver halide emulsion, a green-sensitive silver halide emulsion and a blue-sensitive silver halide emulsion (the temperature and time of chemical ripening of each emulsion are given below.) After the chemical ripening, 0.9 g of 4-hydroxy-6-methyl-1,3,3a7-tetrazaindene and 0.1 g of potassium bromide were added, as a stabilizer, to each of the emulsions.

| (a) Ingredients of a red-sensitive silver iode-bromide emulsion (chemical ripening: 60° C. for 130 minutes) | |
|---|---|
| Silver iodo-bromide emulsion | 700 ml |
| 4-hydroxy-6-methyl-1,3,3a7-tetrazaindene | 0.1 g |
| Gelatin | 32 g |
| Sodium thiosulfate | 10 ml |
| Potassium chloroaurate | 2.3 mg |
| Ammonium thiocyanate | 10 mg |
| Sensitization dye (a) | |
| 1% solution of methanol | 80 ml |
| Ion-exchange water | 1,200 ml |
| (b) Ingredients of a green-sensitive silver iodo-bromide emulsion (chemical ripening: 53° C. for 85 minutes) | |
| Silver iodo-bromide emulsion | 700 ml |
| 4-hydroxy-6-methyl-1,3,3a,7-tetrazaindene | 0.08 g |
| Gelatin | 32 g |
| Sodium thiosulfate | 10 mg |
| Potassium chloroauratc | 1.6 mg |
| Ammonium chiocyanate | 10 mg |
| Sensitization dye (b) | |
| 1% methanol solution | 80 ml |
| Ion-exchange water | 1,200 ml |
| (c) Ingredients of a blue-sensitive silver iodo-bromide emulsion (chemical ripening: 57° C. for 180 minutes) | |
| Silver iodo-bromide emulsion | 700 ml |
| 4-hydroxy-6-methyl-1,3,3a,7-tetrazaindene | 0.13 g |

-continued

| | |
|---|---|
| Gelatin | 32 g |
| Sodium thiosulfate | 10 mg |
| Potassium chloroaurate | 3.4 mg |
| Ammonium chiocyanate | 12 mg |
| Sensitization dye (c) | |
| 1% methanol solution | 80 ml |
| Ion-exchange water | 1,200 ml |

Sensitization dyes (a)

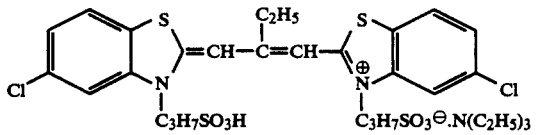

Sensitization dyes (b)

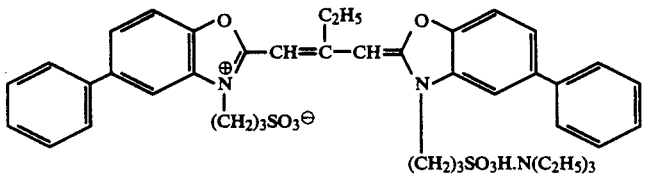

Sensitization dyes (c)

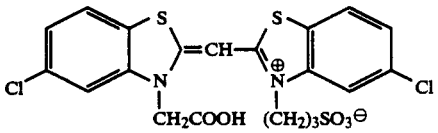

(3) Preparation of an organic silver salt emulsion 28.8 g of 5-methylbenzotriazole silver obtained by reacting 5-methylbenzotriazole with silver nitrate in a water-alcohol mixed solvent, 4.0 g of poly(N-vinylpyrrolidone), 0.65 g of 5-methylbenzotriazole were dispersed by means of an alumina ball mill, thereby producing 200 ml of an emulsion having a pH value of 5.5.

(4) Preparation of emulsions of heat solvent-1

25 g each of heat solvents listed in the following Table 2 was dispersed, by using an alumina ball mill, in 100 ml of an aqueous 0.5% polyvinyl pyrrolidone solution containing 0.04 g of Surface active agent-1, thereby to obtain 120 ml of an emulsion.

Surface active agent-1

-continued

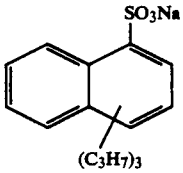

(5)-1 Preparation of an emulsion of dye-providing substance-1

35.5 g of High molecular weight dye-providing substance (1) shown below, 2.4 g Anti-contamination agent W-1 were dissolved in 200 ml of ethylacetate and 15 ml of di-(2-ethylhexyl) phthalate and, subsequently mixed with an aqueous 5% by weight solution of Alkanol XC (manufactured by Dupont.) and 720 ml of an aqueous 6% gelatin solution. The resultant was emulsified by means of a ultrasonic homogenizer and ethylacetate was distilled off, thereby obtaining 795 ml of an emulsion having a pH value of 5.5.

Anti-contamination agent W-1

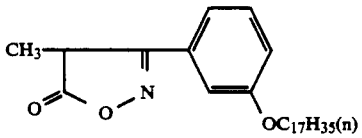

High-molecular weight dye-providing substance (1)

-continued

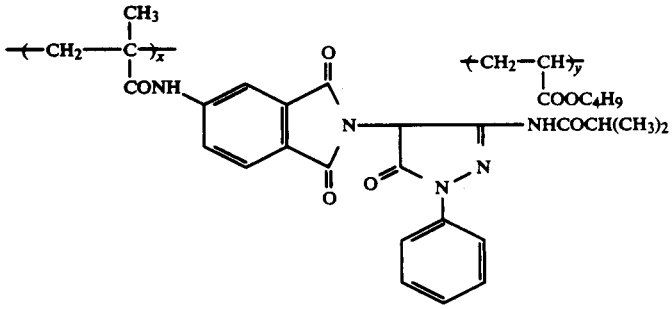

x = 50 wt %
y = 50 wt %

(5)-2 Preparation of an emulsion of dye-providing substance-2

A dye-providing substance emulsion was prepared in substantially the same manner as in the preparation of the emulsion-1, except that, as the dye-providing substance, use was made of the following High molecular weight dye-providing substance (2)

High-molecular weight dye-providing substance (2)

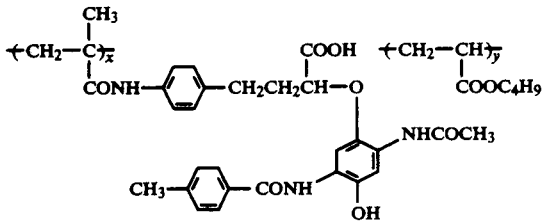

x = 60 wt %
y = 40 wt %

(5)-3 Preparation of an emulsion of dye-providing substance-3

A dye-providing substance emulsion was prepared in substantially the same manner as in the preparation of the emulsion-1, except that, as the dye-providing substance, use was made of the following High molecular weight dye-providing substance (3).

High-molecular weight dye-providing substance (3)

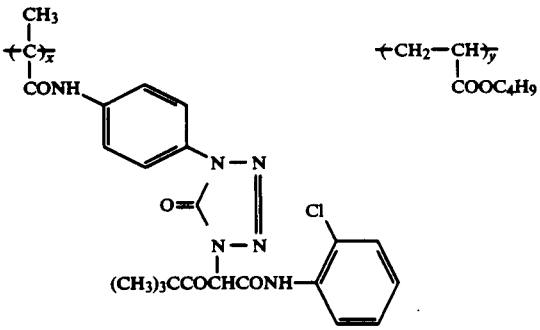

x = 70 wt %
y = 30 wt %

(6) Preparation of a solution of a reducing agent 20.0 g of Reducing agent-1, 3.3 g of Reducing agent-2, each of which are shown below, and 0.50 g of a fluorine-type surface active agent were dissolved in water. The resultant was adjusted to have a pH value of 7.5. Thus, 250 ml of a reducing agent solution having a pH value of 7.5 was obtained.

Reducing agent-1

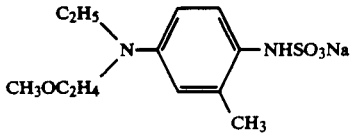

Reducing agent-2

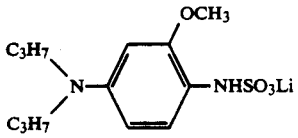

Surface active agent-2

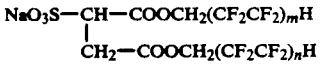

(7) Preparation of photosensitive materials

By using the organic silver salt emulsion, the silver halide emulsions, the heat solvent emulsions, the emulsions of dye-providing substance and the reducing agent solution, each of those were prepared as above, color photosensitive materials 1–24 each being of a multilayer structure were prepared. The composition of each layer is shown in Table 1. In Table 1, the amounts of the photosensitive silver halide emulsions and 5-methylbenzotiazole silver are given in the terms of the amount of silver. The amounts of other ingredients were indicated in terms of the amount per square meter of the photosensitive material.

In Layers 2, 4 and 6 shown in Table 1. 5-methylbenzotriazole, the development inhibitor (ST-1), potassium bromide, sodium chloride were each added to these layers in the form of a methanol solution or an aqueous solution (sodium bromide, potassium chloride).

Coating was performed in the following manner: Layers 1–3 were provided on a support by a simultaneous coating. On the so-formed laminate, Layers 4–7 were provided also by a simultaneous coating.

Surface-active agent-3 of the following formula was incorporated, as a costing-assisting agent, to each of Layers 1–7. Also, as a hardening agent, a product obtained by reacting tetrakis-(vinylsulfonylmethyl) methane and a salt of potassium taurate (reaction ratio; 1:

0.75 (molar ratio) were added to each layer in an amount of 0.04 g per gram of gelatin.

Surface active agent-3

-continued

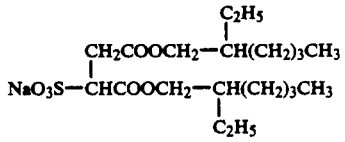

TABLE 1

| | | |
|---|---|---|
| Layer 7 | Protective layer | Gelatin 1.20 g, silica powder 0.20 g, heat solvent* 0.75 g, ultraviolet absorbent (UV-1) 0.20 g, reducing agent 0.12 g, polyrinylpyrrodine 0.25 g, DOP 0.1 g |
| Layer 6 | Blue-sensitive layer | 5-methylbenzotriazole silver 0.61 g, reducing agent 0.76 g, high molecular weight dye-providing substance (2) 1.0 g, blue-sensitive silver halide emulsion 0.32 g, gelatin 2.3 g, polyrinylpyrrodine (K-30) 0.29 g, heat solvent* 3.4 g, 5-methylbenzotriazole 0.02 g, potassium bromide 0.009 g, sodium chloride 0.002 g, ST-1 0.01 g, ST-2 0.0015 g |
| Layer 5 | Second intermediate layer | Gelatin 1.5 g, polyrinylpyrrodine (K-30) 0.28 g, filter dye (F-1) 0.40 g, reducing agent 0.37 g, oil-soluble optical bleaching agent 0.1 g, DOP 0.2 g |
| Layer 4 | Green-sensitive layer | 5-methylbenzotriazole silver 0.29 g, reducing agent 0.37 g, high molecular weight dye-providing substance (1) 0.5 g, anti-irradiation dye-1 0.02 g, green-sensitive silver halide emulsion 0.27 g, gelatin 1.9 g, polyrinylpyrrodine 0.28 g, heat solvent 3.0 g, 5-methylbenzotriazole 0.02 g, potassium bromide 0.009 g, sodium chloride 0.002 g, ST-1 0.01 g, ST-2 0.0003 g |
| Layer 3 | First intermediate layer | Gelatin 1.5 g, reducing agent 0.41 g, ultraviolet absorbent (UV-1) 0.2 g, polyrinylpyrrodine 0.15 g, DOP 0.1 g |
| Layer 2 | Red-sensitive layer | 5-methylbenzotriazole silver 0.72 g, reducing agent 0.60 g, high molecular weight dye-providing substance (3) 1.0 g, red-sensitive silver halide emulsion 0.36 g, gelatin 2.0 g, anti-irradiation dye-2 0.02 g, polyrinylpyrrodine (K-30) 0.21 g, heat solvent 3.0 g, 5-methylbenzotriazole 0.02 g, potassium bromide 0.009 g, sodium chloride 0.002 g, ST-1 0.01 g, ST-2 0.0028 g |
| Layer 1 | Gelatin | Gelatin 1.2 g, heat solvent* 1.0 g, reducing agent 0.4 g |
| Support | | A transparent film of polyethylene terephthalate of 100 μm in thickness, which is undercoated with latex |

DOP: di-(2-ethylhexyl)phthalate
*: The kind of heat solvent contained in each sample is shown in Table 2.
The compounds described in the above table are illustrated in the following pages.

F-1

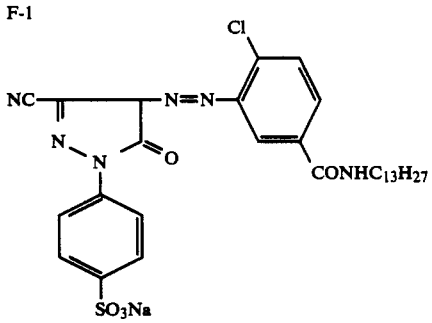

TABLE 1-continued

UV-1

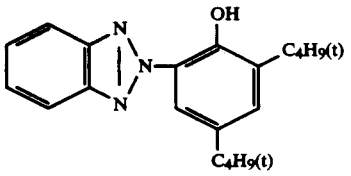

ST-1

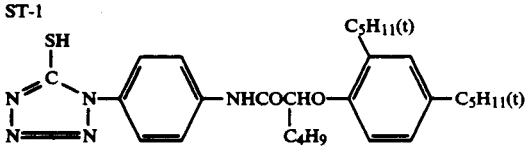

Anti-irradition dye-1

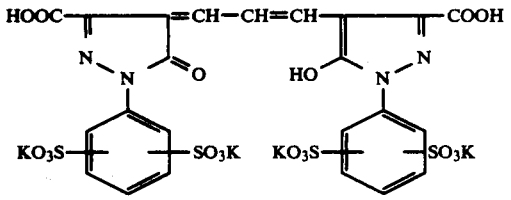

ST-2

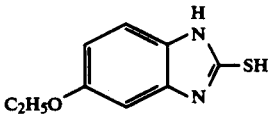

Oil-soluble optical bleaching agent

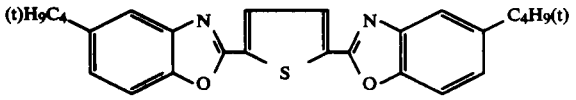

(UVITEX OB, manufactured by CIBA-GEIGY)

Anti-irradiation dye-2

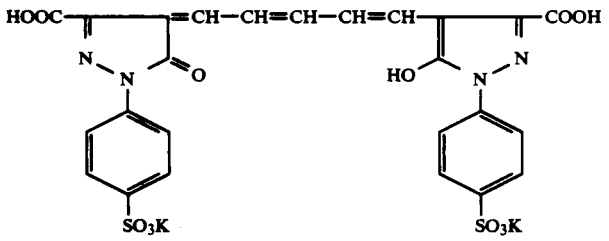

Each of the so-prepared samples of the color photosensitive material was stored at 25° C. for 5 days. Subsequently, each sample was subjected to heat treatment at 38° C. for 3 days to be cured as desired.

On one side of a baryta paper (a surface provided with a baryta layer) with a baryta content of 100 g/m, a polyvinyl layer having the following composition was provided as an image-receiving layer

| | |
|---|---|
| Polyvinyl chloride | 12 g |
| Image stabilizer-1 | 0.8 g |
| Image stabilizer-2 | 0.2 g |
| Image stabilizer-3 | 0.2 g |
| Image stabilizer-4 | 0.3 g |
| Image stabilizer-5 | 0.1 g |
| Image stabilizer-6 | 0.2 g |
| Development accelerator | 0.3 g |
| DOP | 1.0 g |
| Tricresylphosphate | 0.5 g |

-continued

Image stabilizer-1

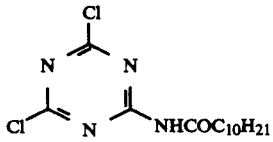

Image stabilizer-2

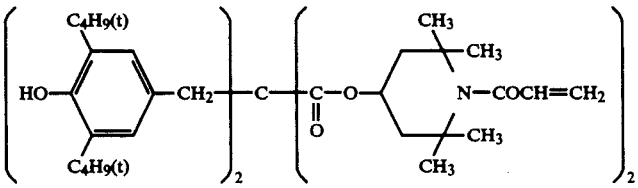

Image stabilizer-3

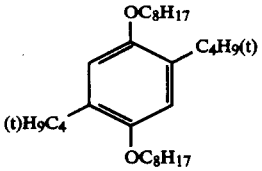

Image stabilizer-4

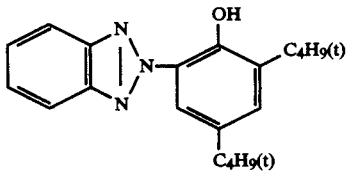

Image stabilizer-5

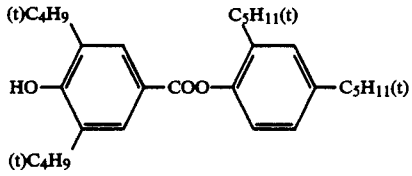

Image stabilizer-6

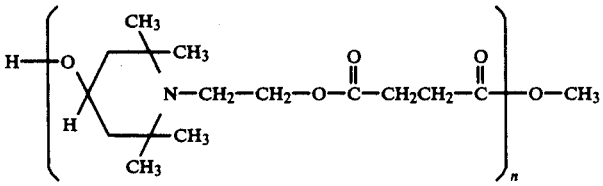

Development accelerator-1
$(HO-CH_2CH_2-S-CH_2)_2$

The photosensitive materials 1 - 24 were evaluated with prespect to the following properties: (Hardening property)

A specimen of the photosensitive material (10 cm×10 cm) was dipped in pure water maintained at 30° C for one minute. After removing water remaining on the surface with a filter paper, it was weighed (W1(g)). It was also weighed after drying at 23° C and 50% (W2(g)).

The hardening property of this specimen was obtained by the following calculation:

$$\text{(Hardening property)} = 100 \times \frac{W1 - W2}{\text{Amount of binder per square meter}}$$

-continued $$= 100 \times \frac{(W1 - W2)}{0.131}$$

Photosensitive materials 1 - 24 were each subjected to exposure, through an optical step wedge, of the respective light of monochromatic light of blue, green and red (interference filters of 430 nm, 540 n and 640 nm, each manufactured by Toshiba Glass Co. were respectively employed for blue, green, and red light exposure). After laminating each sample with an image-receiving layer, heat development was performed at 140° C. for 80 seconds.

After the heat development, the image-receiving element was removed from the photosensitive material. Images of cyan, magenta and yellow dyes were formed in the image-receiving layer (indicated as R, G and B).

The density of each of the so-formed dye images was measured by means of a reflecting densinometer (PDA-65, manufactured by Konica). With respect to each of B, G and R, the maximum density (Dmax) and the minimum density (Dmin) were obtained.

(Storablity)

Each sample was stored at 50° C. and a relative humidity of 60% for 3 days and subjected to the same measurement as effected for the evaluation of the photographic property.

(Volatility)

Each specimen of the photosensitive material (10 cm×10 cm) was weighed at 23° C. and 55% (W1(mg)), and fixed to a heated plate maintained at 140° C.±2° C. for 5 minutes. Subsequently, the humidity of each specimen was adjusted at 23° C. and 55% for 2 hours. After drying, each specimen was weighed (W2 (mg)).

The volatility was given in terms of (W1–W2) mg. The results of the above measurements are shown in Table 2.

From the results, it can be understood that Samples 6–24, each containing the heat solvent of the present invention, produced images with a high maximum density, without causing an increase in minimum density. Also, it can be confirmed that the presence of the heat solvent of the present invention did not exert any adverse effect on the hardening property and the storablity of the photosensitive material. Further, it should be noted that the heat solvent of the present invention did not readily volatilize or gasify even when the photosensitive material was allowed to stand at 140° C. (the temperature at which development is effected) for 5 minutes.

TABLE 2

| Sample | | Hardening | Photographic Property | | | | | | Storablity | | | | | | Volatility |
|---|---|---|---|---|---|---|---|---|---|---|---|---|---|---|---|
| | | | Maximum Density | | | Minimum Density | | | Maximum Density | | | Minimum Density | | | |
| No. | Heat Solvent | Property | B | G | R | B | G | R | B | G | R | B | G | R | (mg) |
| 1 | Comparative Heat Solvent - (1) | 840 | 1.84 | 2.09 | 2.13 | 0.16 | 0.10 | 0.04 | 1.74 | 2.03 | 2.06 | 0.24 | 0.14 | 0.09 | 34 |
| 2 | Comparative Heat Solvent - (2) | 800 | 1.62 | 1.81 | 2.01 | 0.14 | 0.09 | 0.04 | 1.48 | 1.63 | 1.89 | 0.19 | 0.11 | 0.08 | 26 |
| 3 | Comparative Heat Solvent - (3) | 760 | 1.37 | 1.61 | 1.74 | 0.11 | 0.09 | 0.04 | 1.36 | 1.55 | 1.72 | 0.15 | 0.10 | 0.07 | 12 |
| 4 | Comparative Heat Solvent - (4) | 940 | 1.69 | 1.90 | 1.94 | 0.14 | 0.10 | 0.04 | 1.40 | 1.69 | 1.86 | 0.17 | 0.13 | 0.08 | 20 |
| 5 | Comparative Heat Solvent - 5 | 900 | 1.42 | 1.68 | 1.93 | 0.13 | 0.09 | 0.04 | 1.34 | 1.52 | 1.81 | 0.19 | 0.12 | 0.08 | 30 |
| 6 | Comparative Heat Solvent - (6) | 970 | 1.21 | 1.73 | 1.99 | 0.11 | 0.08 | 0.03 | 1.06 | 1.51 | 1.80 | 0.16 | 0.11 | 0.07 | 11 |
| 7 | TS-3 | 760 | 1.70 | 2.14 | 2.21 | 0.14 | 0.09 | 0.04 | 1.66 | 2.04 | 2.13 | 0.20 | 0.13 | 0.07 | 3 |
| 8 | TS-6 | 750 | 1.69 | 2.06 | 2.14 | 0.15 | 0.09 | 0.04 | 1.60 | 1.94 | 2.07 | 0.19 | 0.13 | 0.08 | 4 |
| 9 | TS-13 | 730 | 1.74 | 2.05 | 2.16 | 0.14 | 0.09 | 0.04 | 1.70 | 2.03 | 2.10 | 0.19 | 0.13 | 0.07 | 2 |
| 10 | TS-15 | 680 | 1.80 | 2.13 | 2.27 | 0.14 | 0.10 | 0.04 | 1.74 | 2.02 | 2.13 | 0.19 | 0.13 | 0.07 | 2 |
| 11 | TS-17 | 650 | 1.81 | 2.09 | 2.23 | 0.14 | 0.10 | 0.03 | 1.74 | 1.96 | 2.14 | 0.18 | 0.13 | 0.07 | 1 |
| 12 | TS-21 | 690 | 1.69 | 2.02 | 2.09 | 0.15 | 0.08 | 0.03 | 1.60 | 1.98 | 2.03 | 0.18 | 0.12 | 0.07 | 2 |
| 13 | TS-24 | 640 | 1.73 | 2.04 | 2.20 | 0.13 | 0.08 | 0.04 | 1.06 | 1.84 | 2.13 | 0.19 | 0.13 | 0.07 | 1 |
| 14 | TS-29 | 680 | 1.76 | 1.99 | 2.21 | 0.14 | 0.08 | 0.04 | 1.72 | 1.89 | 2.14 | 0.20 | 0.13 | 0.07 | 2 |
| 15 | TS-31 | 600 | 1.84 | 2.07 | 2.14 | 0.14 | 0.09 | 0.04 | 1.77 | 2.09 | 2.07 | 0.19 | 0.13 | 0.07 | 4 |
| 16 | TS-41 | 660 | 1.73 | 2.06 | 2.16 | 0.14 | 0.09 | 0.04 | 1.69 | 2.02 | 2.11 | 0.19 | 0.13 | 0.07 | 3 |
| 17 | TS-43 | 640 | 1.86 | 2.07 | 2.19 | 0.14 | 0.09 | 0.04 | 1.81 | 2.10 | 2.01 | 0.19 | 0.13 | 0.07 | 3 |
| 18 | Ts-46 | 650 | 1.82 | 2.03 | 2.20 | 0.14 | 0.08 | 0.04 | 1.80 | 2.07 | 2.11 | 0.19 | 0.14 | 0.07 | 4 |
| 19 | TS-52 | 680 | 1.76 | 2.11 | 2.17 | 0.14 | 0.10 | 0.04 | 1.72 | 2.01 | 2.11 | 0.20 | 0.13 | 0.07 | 2 |
| 20 | TS-61 | 670 | 1.84 | 2.04 | 2.15 | 0.15 | 0.09 | 0.04 | 1.86 | 2.03 | 2.11 | 0.19 | 0.13 | 0.08 | 4 |
| 21 | TS-63 | 640 | 1.87 | 2.16 | 2.18 | 0.15 | 0.10 | 0.04 | 1.76 | 2.03 | 2.09 | 0.20 | 0.13 | 0.07 | 4 |
| 22 | TS-68 | 620 | 1.73 | 2.00 | 2.11 | 0.13 | 0.09 | 0.03 | 1.70 | 1.94 | 2.01 | 0.19 | 0.13 | 0.07 | 5 |
| 23 | TS-70 | 660 | 1.78 | 2.06 | 2.16 | 0.13 | 0.09 | 0.04 | 1.71 | 2.01 | 2.07 | 0.20 | 0.13 | 0.08 | 4 |
| 24 | TS-82 | 640 | 1.82 | 2.08 | 2.20 | 0.14 | 0.09 | 0.04 | 1.74 | 2.01 | 2.11 | 0.20 | 0.13 | 0.09 | 2 |

Comparative heat solvents (1) - (6) employed are given below:

(1)

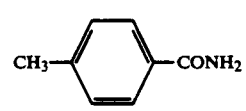

(2)

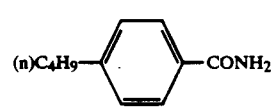

(3)

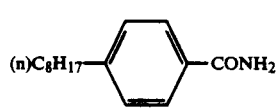

-continued (4)

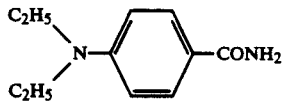

(5)

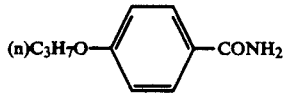

(6)

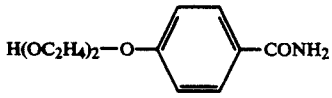

Example 2

The heat solvent emulsions used in Example 1 were stirred and retained at 50° C. for 4 hours. Before and after the retention, the granule size of each emulsion was observed by a microscope. The results show that, in each emulsion of the heat solvent of the present invention, there was no change in grain size (average grain size; 1–1.5 μm). In contrast, in the case of emulsions containing Comparative solvents (1)–(4), there was observed remarkable agglomeration (average grain size: 4 - 25 μm).

Example 3

Photosensitive materials 25–44 were obtained in substantially the same manner as in Example 1, except that the kind and the amount of the heat solvent employed in Layers 1–7 were changed to those described in Table 3. In the same manner as in Example 1, the maximum and minimum densities of obtained images were measured. The results are shown in Table 3. From the results, it is understood that in the case of Samples 33–44 each containing the heat solvent of the present invention (TS-3, 15, 29), the hardening property of each sample did not deteriorate even as the amount of the heat solvent was increased. Also it is confirmed that the maximum density of each of Samples 33–44 increased with the increase in the amount of the heat solvent. An especially satisfactory maximum density was obtained when the ratio of the heat solvent to the binder (gelatin and polyvinylpyrrolidone) was 1.0 or more (see Samples 35, 36, 39, 40, 43, 44.) On the other hand, Samples 25 - 32 containing Comparative heat solvent (2) or (6), the hardened layer of each sample was considerably deteriorated, especially when the amount of the solvent increased. In contrast to the samples each containing the heat solvent of the present invention, in the case of the samples containing Comparative heat solvent, the increase in maximum density was small while the increase in minimum density was large.

TABLE 3

| Sample | Heat Solvent | | | | | | Hardening | Maximum Density | | | Minimum Density | | |
|---|---|---|---|---|---|---|---|---|---|---|---|---|---|
| | | Amount | | | | | | | | | | | |
| No. | Kind | Layer 1 | Layer 2 | Layer 4 | Layer 6 | Layer 7 | Property | B | G | R | B | G | R |
| 25 | Comparative Solvent - (2) | 0.8 | 2.4 | 2.4 | 2.8 | 0.45 | 740 | 1.47 | 1.72 | 1.81 | 0.12 | 0.07 | 0.02 |
| 26 | Comparative Solvent - (2) | 1.0 | 3.0 | 3.0 | 3.4 | 0.75 | 780 | 1.63 | 1.88 | 2.07 | 0.15 | 0.10 | 0.04 |
| 27 | Comparative Solvent - (2) | 1.5 | 3.6 | 3.6 | 4.0 | 1.0 | 840 | 1.70 | 1.94 | 2.21 | 0.18 | 0.12 | 0.06 |
| 28 | Comparative Solvent - (2) | 2.0 | 4.0 | 4.0 | 4.6 | 1.25 | 920 | 1.81 | 1.99 | 2.27 | 0.22 | 0.14 | 0.07 |
| 29 | Comparative Solvent - (6) | 0.8 | 2.4 | 2.4 | 2.8 | 0.45 | 910 | 1.03 | 1.54 | 1.80 | 0.09 | 0.07 | 0.03 |
| 30 | Comparative Solvent - (6) | 1.0 | 3.0 | 3.0 | 3.4 | 0.75 | 960 | 1.20 | 1.69 | 1.94 | 0.11 | 0.09 | 0.03 |
| 31 | Comparative Solvent - (6) | 1.5 | 3.6 | 3.6 | 4.0 | 1.0 | (*1) | 1.29 | 1.89 | 2.13 | 0.12 | 0.10 | 0.04 |
| 32 | Comparative Solvent - (6) | 2.0 | 4.0 | 4.0 | 4.6 | 1.25 | (*1) | 1.40 | 1.92 | 2.24 | 0.13 | 0.11 | 0.04 |
| 33 | TS-3 | 0.8 | 2.4 | 2.4 | 2.8 | 0.45 | 720 | 1.56 | 2.07 | 2.14 | 0.12 | 0.07 | 0.03 |
| 34 | TS-3 | 1.0 | 3.0 | 3.0 | 3.4 | 0.75 | 750 | 1.72 | 2.15 | 2.24 | 0.14 | 0.09 | 0.04 |
| 35 | TS-3 | 1.5 | 3.6 | 3.6 | 4.0 | 1.0 | 770 | 1.99 | 2.29 | 2.32 | 0.16 | 0.10 | 0.05 |
| 36 | TS-3 | 2.0 | 4.0 | 4.0 | 4.6 | 1.25 | 790 | 2.29 | 2.31 | 2.39 | 0.19 | 0.12 | 0.06 |
| 37 | TS-15 | 0.8 | 2.4 | 2.4 | 2.8 | 0.45 | 540 | 1.68 | 2.14 | 2.19 | 0.11 | 0.07 | 0.03 |
| 38 | TS-15 | 1.0 | 3.0 | 3.0 | 3.4 | 0.75 | 590 | 1.84 | 2.20 | 2.31 | 0.14 | 0.09 | 0.04 |
| 39 | TS-15 | 1.5 | 3.6 | 3.6 | 4.0 | 1.0 | 620 | 2.11 | 2.28 | 2.40 | 0.19 | 0.11 | 0.06 |
| 40 | TS-15 | 2.0 | 4.0 | 4.0 | 4.6 | 1.25 | 630 | 2.28 | 2.26 | 2.45 | 0.22 | 0.13 | 0.07 |
| 41 | TS-29 | 0.8 | 2.4 | 2.4 | 2.8 | 0.45 | 640 | 1.62 | 1.83 | 2.08 | 0.12 | 0.07 | 0.03 |
| 42 | TS-29 | 1.0 | 3.0 | 3.0 | 3.4 | 0.75 | 680 | 1.80 | 1.97 | 2.26 | 0.15 | 0.08 | 0.04 |
| 43 | TS-29 | 1.5 | 3.6 | 3.6 | 4.0 | 1.0 | 720 | 1.98 | 2.11 | 2.34 | 0.18 | 0.10 | 0.05 |
| 44 | TS-29 | 2.0 | 4.0 | 4.0 | 4.6 | 1.25 | 740 | 2.14 | 2.27 | 2.44 | 0.23 | 0.12 | 0.06 |
| 45 | TS-93 | 0.9 | 2.5 | 2.5 | 2.9 | 0.45 | 560 | 1.65 | 2.11 | 2.15 | 0.12 | 0.08 | 0.04 |
| 46 | TS-93 | 1.6 | 3.8 | 3.8 | 4.0 | 1.0 | 640 | 2.09 | 2.22 | 2.30 | 0.16 | 0.11 | 0.06 |
| 47 | TS-100 | 0.8 | 2.4 | 2.4 | 2.8 | 0.45 | 650 | 1.62 | 1.83 | 2.08 | 0.12 | 0.07 | 0.03 |
| 48 | TS-100 | 1.0 | 3.0 | 3.0 | 3.4 | 0.75 | 690 | 1.79 | 1.95 | 2.24 | 0.14 | 0.07 | 0.04 |
| 49 | TS-110 | 0.8 | 2.4 | 2.4 | 2.8 | 0.45 | 640 | 1.60 | 1.80 | 2.05 | 0.11 | 0.07 | 0.03 |
| 50 | TS-110 | 1.0 | 3.0 | 3.0 | 3.4 | 0.75 | 690 | 1.78 | 1.94 | 2.22 | 0.14 | 0.07 | 0.04 |

(*1) The hardening property could not be measured because the Samples did not cure sufficiently.

Example 4

In the photosensitive material 10 prepared in Example 1, the same experiment as in Example 1 was performed, except that the heat solvent was changed from TS-15 to a mixed solvent of TS-15 and Comparative solvent (5).

The ratio of TS-15 and Comparative solvent varies as shown in Table 4.

The results obtained are shown in Table 4.

The results show that when the heat solvent of the present invention was used in combination with Comparative solvent, desirable effects could be obtained when the heat solvent of the present invention was used in an amount of 50% by weight or more of the total amount of the solvents employed. Especially desirable effects were attained when the heat solvent of the present invention was employed in an amount of 70% or more of the total amount of the solvents.

TABLE 4

| Sample No. | Amount Ratio (wt %) ST-15: Comparative Solvent - 5 | Hardening Property | Photographic Property: Maximum Density B | G | R | Minimum Density B | G | R | Storability: Maximum Density B | G | R | Minimum Density B | G | R | Volatility (mg) |
|---|---|---|---|---|---|---|---|---|---|---|---|---|---|---|---|
| 51 | 0:100 | 920 | 1.64 | 1.89 | 2.24 | 0.15 | 0.10 | 0.04 | 1.44 | 1.68 | 1.83 | 0.20 | 0.12 | 0.09 | 32 |
| 52 | 40:60 | 860 | 1.70 | 1.94 | 2.26 | 0.15 | 0.10 | 0.04 | 1.49 | 1.69 | 1.89 | 0.20 | 0.12 | 0.09 | 17 |
| 53 | 60:40 | 810 | 1.77 | 2.04 | 2.29 | 0.14 | 0.09 | 0.04 | 1.59 | 1.84 | 1.96 | 0.19 | 0.13 | 0.08 | 10 |
| 54 | 80:20 | 760 | 1.79 | 2.11 | 2.30 | 0.15 | 0.10 | 0.04 | 1.68 | 1.96 | 2.14 | 0.19 | 0.12 | 0.08 | 4 |
| 55 | 90:10 | 710 | 1.84 | 2.19 | 2.27 | 0.15 | 0.10 | 0.04 | 1.74 | 2.05 | 2.15 | 0.19 | 0.13 | 0.08 | 2 |
| 56 | 100:0 | 660 | 1.84 | 2.20 | 2.29 | 0.14 | 0.10 | 0.04 | 1.77 | 2.10 | 2.19 | 0.19 | 0.14 | 0.07 | 1 |

I claim:

1. A process of imagewise exposing a heat developing photosensitive material comprising silver halide, a binder, a reducing agent and a heat solvent, laying the material and an image receiving element one upon another during or after heat, and transferring the image formed onto an image receiving layer of the image receiving element under dry conditions, wherein said heat solvent is at least one selected from the group consisting of compounds represented by Formulae I, II and III;

Formula I

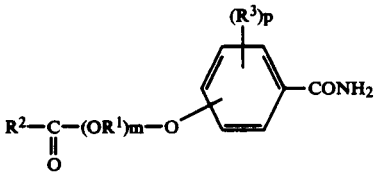

Formula II

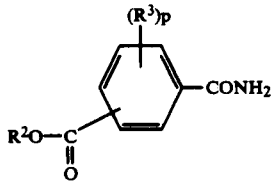

Formula III

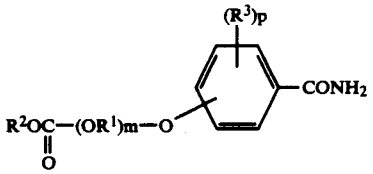

wherein $R^1$ represents an alkylene group; $R^2$ represents an alkyl group, an alkenyl group or aryl group, each of which may either be substituted or unsubstituted; $R^3$ represents an alkyl group, an alkoxy group, an aryl group or an aryloxy group, each of which may either be substituted or unsubstituted, a halogen atom or a $-CONH_2$ group; p represents an integer of 0 to $\propto$ and, when p is 2 or more, $R^3$ may be the identical or the different from each other; m represents 0, 1 or 2.

2. The process of claim 1, wherein said $R^1$ is an alkylene group having a carbon number of 2 to 4.

3. The process of claim 1, wherein said $R^2$ is an alkyl group.

4. The process of claim 1, wherein said $R^2$ is an alkyl group having a carbon number of 1 to 6.

5. The process of claim 1, wherein said $R^2$ is a propyl group.

6. The process of claim 1, wherein a substitutent of said $R^2$ is an alkyl group, an alkoxy group or a halogen atom.

7. The process of claim 1, wherein said heat solvent has a melting point of 80° C. to 200° C.

8. The process of claim 1, wherein said heat solvent has a melting point of 100° C. to 180° C.

9. The process of claim 1, wherein the content of said heat solvent is 20 to 500 % by weight of the total amount of a binder.

10. The process of claim 1, wherein the content of said heat solvent is 40 to 250% by weight of the total amount of a binder.

11. The process of claim 1, wherein the content of said heat solvent is 50% or more by weight of the total amount of a heat solvent.

12. The process of claim 1, wherein the content of said heat solvent is 70% or more by weight of the total amount of a heat solvent.

13. The process of claim 1, wherein said reducing agent is a salt of N-(p-N, N-dialkylamino)phenylsulfamic acid.

14. The process of claim 1, wherein said reducing agent is sodium salt of p-N, N-diethylaminophenylsulfamic acid.

15. The process of claim 1, wherein said reducing agent is lithium salt of 4-N, N-dipropylamino-2-methoxyphenyl-sulfamic acid.

16. The process of claim 1, wherein the content of said reducing agent is 0.01 mole to 10 moles per mole of silver halide.

17. The process of claim 1, wherein the content of said reducing agent is 0.1 mole to 5 moles per mole of silver halide.

18. The process of claim 1, wherein said binder is gelatin.

19. The process of claim 1, wherein the content of said binder is 0.3 to 40 g per square meter of a support.

20. The process of claim 1, wherein the content of said binder is 0.5 to 20 g per square meter of a support.

21. The process of claim 1, wherein the content of said binder is 0.1 to 10 g per gram of a dye-providing substance.

22. The process of claim 1, wherein the content of said binder is 0.25 to 4 g per gram of a dye-providing substance.

23. The process of claim 1, wherein said heating is carried out at a temperature within the range of from 80° C. to 200° C. for 1 to 180 seconds.

24. The process of claim 1, wherein said heating is carried out at a temperature within the range of from 80° C. and 200° C. for 1.5 to 120 seconds.

25. The process of claim 1, wherein said heating is carried out at a temperature within the range of from 100° C. to 170° C. for 1 to 180 seconds.

26. The process of claim 1, wherein said heating is carried out at a temperature within the range of from 100° C. to 170° C. for 1.5 to 120 seconds.

* * * * *